US011795560B2

(12) United States Patent
Kobayashi et al.

(10) Patent No.: US 11,795,560 B2
(45) **Date of Patent: *Oct. 24, 2023**

(54) HOT STAMPED BODY

(71) Applicant: NIPPON STEEL CORPORATION, Tokyo (JP)

(72) Inventors: Akinobu Kobayashi, Tokyo (JP); Takehiro Takahashi, Tokyo (JP); Yasuaki Kawamura, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 72 days.

This patent is subject to a terminal disclaimer.

(21) Appl. No.: 17/611,848

(22) PCT Filed: May 29, 2020

(86) PCT No.: PCT/JP2020/021443

§ 371 (c)(1),
(2) Date: Nov. 16, 2021

(87) PCT Pub. No.: WO2020/241864

PCT Pub. Date: Dec. 3, 2020

(65) Prior Publication Data

US 2022/0213609 A1 Jul. 7, 2022

(30) Foreign Application Priority Data

May 31, 2019 (JP) ..... 2019-102299

(51) Int. Cl.

| | |
|---|---|
| ***C25D 3/56*** | (2006.01) |
| ***C22C 18/00*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C25D 5/50*** | (2006.01) |

(52) U.S. Cl.

CPC ..... *C25D 3/562* (2013.01); *C22C 18/00* (2013.01); *C22C 38/001* (2013.01); *C22C 38/002* (2013.01); *C22C 38/02* (2013.01); *C22C 38/04* (2013.01); *C22C 38/06* (2013.01); *C25D 5/50* (2013.01); *Y10T 428/12611* (2015.01)

(58) Field of Classification Search

None

See application file for complete search history.

(56) References Cited

U.S. PATENT DOCUMENTS

| | | | | |
|---|---|---|---|---|
| 2005/0139291 | A1* | 6/2005 | Taira | C23C 2/26 148/277 |
| 2012/0164472 | A1 | 6/2012 | Kuhn et al. | |
| 2012/0321903 | A1 | 12/2012 | Nakamaru et al. | |
| 2015/0083276 | A1 | 3/2015 | Nakano et al. | |
| 2016/0368243 | A1* | 12/2016 | Takahashi | C22C 38/02 |
| 2019/0032236 | A1* | 1/2019 | Hirasawa | B23K 35/3602 |

FOREIGN PATENT DOCUMENTS

| | | | |
|---|---|---|---|
| EP | 2 684 985 | A1 | 1/2014 |
| JP | 2000129487 | A * | 5/2000 |
| JP | 2005-113233 | A | 4/2005 |
| JP | 2011-246801 | A | 12/2011 |
| JP | 2012-1816 | A | 1/2012 |
| JP | 2012-197505 | A | 10/2012 |
| JP | 2013-503254 | A | 1/2013 |
| JP | 2016-29214 | A | 3/2016 |
| JP | 2016-125101 | A | 7/2016 |

* cited by examiner

*Primary Examiner* — Seth Dumbris

(74) *Attorney, Agent, or Firm* — Birch, Stewart, Kolasch & Birch, LLP

(57) ABSTRACT

The present invention relates to a hot stamped body comprising a steel sheet and a plating layer formed on at least one surface of the steel sheet, wherein the plating layer is comprised of a ZnO region present on a surface side of the plating layer and having an oxygen concentration of 10 mass % or more and an Ni—Fe—Zn alloy region present on a steel sheet side of the plating layer and having an oxygen concentration of less than 10 mass %, and an average concentration of a total of Fe, Mn and Si in the ZnO region is 5 mass % or more and 30 mass % or less.

4 Claims, No Drawings

HOT STAMPED BODY

FIELD

The present invention relates to a hot stamped body. More specifically, the present invention relates to a hot stamped body having improved coating peeling resistance.

BACKGROUND

In recent years, much use has been made of hot stamping (hot pressing) for shaping steel sheet used for automobile members. "Hot stamping" is the method of press-forming a steel sheet in a state heated to a temperature of the austenite region and quenching (cooling) the sheet by the press dies at the same time as shaping. It is one of the methods of shaping steel sheet excellent in strength and dimensional precision. Further, in the steel sheet used for hot stamping, sometimes the surface of the steel sheet is provided with a plating layer such as a Zn—Ni alloy plating layer (for example PTLs 1 to 3).

In the hot stamped body obtained by hot stamping a plated steel sheet comprised of a steel sheet having a plating layer (also referred to as a "hot pressed member"), in particular when used for an automobile member, sometimes, for the purpose of increasing the corrosion resistance, etc., for example, the hot stamped body is chemically treated to form a phosphate coating film, then is coated by electrodeposition to form a coating film on the hot stamped body. Therefore, it is important that the coating film not easily peel off from the body after formation of such a coating film.

To improve the adhesion between a hot stamped body and coating film, it is known to provide a ZnO layer at the surfacemost layer of the hot stamped body. For example, PTLs 4 and 5 describe a hot-pressed member comprising a steel sheet, a Ni-diffusion region which is present in a surface layer of the steel sheet, and an intermetallic compound layer and a ZnO layer which are provided in order on the Ni-diffusion region, the intermetallic compound layer corresponding to a γ phase present in a phase equilibrium diagram of a Zn—Ni alloy, wherein a spontaneous immersion potential indicated in a 0.5 M NaCl aqueous air-saturated solution at 25° C.±5° C. is −600 to −360 mV based on a standard hydrogen electrode. PTLs 4 and 5 teach that since the hot-pressed member has the ZnO layer on its surface, it has excellent adhesion of the coating film to the chemical conversion coating film.

CITATIONS LIST

Patent Literature

[PTL 1] Japanese Unexamined Patent Publication No. 2012-197505

[PTL 2] Japanese Unexamined Patent Publication No. 2016-29214

[PTL 3] Japanese Unexamined Patent Publication No. 2016-125101

[PTL 4] Japanese Unexamined Patent Publication No. 2011-246801

[PTL 5] Japanese Unexamined Patent Publication No. 2012-1816

SUMMARY

Technical Problem

The hot pressed member described in PTLs 4 and 5 is intended to secure coating film adhesion with the chemical conversion coating film formed on its surface by the presence of the ZnO layer at the surfacemost layer. However, the ZnO present at the surfacemost layer of the hot pressed member is sparse and the strength is relatively low, therefore, even if peeling at the interface of the ZnO layer and coating film is suppressed, peeling or fracture is liable to occur from the ZnO layer itself. In other words, part of the ZnO layer on which the coating film is formed is liable to peel off or fracture and as a result the coating film is liable to peel off (be removed) from the hot pressed member. Accordingly, in the hot pressed member described in PTLs 4 and 5, there is room for improvement in terms of the prevention of peeling of the coating film from the hot pressed member, i.e., improvement of the coating peeling resistance.

Therefore, an object of the present invention is to provide a hot stamped body having improved coating peeling resistance by a novel constitution.

Solution to Problem

The present inventors discovered that, to achieve this object, it is effective to provide a ZnO region at the surface layer of a plating layer formed on a steel sheet to thereby secure adhesion of a ZnO layer and a coating film while making that ZnO region contain not only oxygen and zinc, but also elements other than zinc to thereby improve the strength of the ZnO region at the surface layer of the plating layer. If the strength of the ZnO region is improved, peeling or fracture from the ZnO region can be sufficiently prevented and a hot stamped body having improved coating peeling resistance can be obtained.

The present invention to achieve the above object is as follows:

(1) A hot stamped body comprising a steel sheet and a plating layer formed on at least one surface of the steel sheet, wherein the plating layer is comprised of a ZnO region present on a surface side of the plating layer and having an oxygen concentration of 10 mass % or more and an Ni—Fe—Zn alloy region present on a steel sheet side of the plating layer and having an oxygen concentration of less than 10 mass %, and an average concentration of a total of Fe, Mn and Si in the ZnO region is 5 mass % or more and 30 mass % or less.

(2) The hot stamped body according to (1), wherein concentrations of Zn, O, Mn and Si in the Ni—Fe—Zn alloy region decrease from the surface side of the plating layer toward the steel sheet side.

(3) The hot stamped body according to (1) or (2), wherein the Ni—Fe—Zn alloy region is comprised of, in order from a surface side of the plating layer, a first region having an Fe concentration of less than 60 mass % and a second region having an Fe concentration of 60 mass % or more, a Zn/Ni mass ratio in the first region is 2.0 or more and 15.0 or less, and an average Zn/Ni mass ratio in the second region is 0.5 or more and 2.0 or less.

(4) The hot stamped body according to (3), wherein the average Zn/Ni mass ratio in the second region is 0.8 or more and 1.2 or less.

(5) The hot stamped body according to any one of (1) to (4), wherein a thickness of the ZnO region is 1.0 μm or more and 5.0 μm or less.

Advantageous Effects of Invention

According to the present invention, it is possible to provide a hot stamped body increased in strength of a ZnO region present on a surface side of a plating layer, prevented from peeling or fracture of the ZnO itself, and improved in coating peeling resistance.

DESCRIPTION OF EMBODIMENTS

<Hot Stamped Body>

The hot stamped body according to the present invention comprises a steel sheet and a plating layer formed on at least one surface of the steel sheet. Preferably, the plating layer is formed on both surfaces of the steel sheet.

[Steel Sheet]

The chemical composition of the steel sheet of the present invention is not particularly limited and may be determined considering the strength of the hot stamped body after hot stamping and the hardenability at the time of hot stamping. Below, elements able to be contained in the steel sheet in the present invention will be explained. The "%" showing the contents of the elements in the chemical composition means mass % unless otherwise indicated.

Preferably, the steel sheet in the present invention can contain, by mass %, C: 0.05% or more and 0.70% or less, Mn: 0.5% or more and 11.0% or less, Si: 0.05% or more and 2.50% or less, Al: 0.001% or more and 1.500% or less, P: 0.100% or less, S: 0.100% or less, N: 0.010% or less, and O: 0.010% or less.

(C: 0.05% or More and 0.70% or Less)

C (carbon) is an element effective for improving the strength of the steel sheet. Automobile members, for example, sometimes require high strengths of 980 MPa or more. To sufficiently secure strength, the C content is preferably 0.05% or more. On the other hand, if excessively containing C, sometimes the workability of the steel sheet falls, therefore the C content is preferably 0.70% or less. The lower limit of the C content is preferably 0.10%, more preferably 0.12%, still more preferably 0.15%, most preferably 0.20%. Further, the upper limit of the C content is preferably 0.65%, more preferably 0.60%, still more preferably 0.55%, most preferably 0.50%.

(Mn: 0.5% or More and 11.0% or Less)

Mn (manganese) is an element effective for improving the hardenability at the time of hot stamping. To reliably obtain this effect, the Mn content is preferably 0.5% or more. On the other hand, if excessively containing Mn, the Mn segregates and the strength, etc., of the body after hot stamping are liable to become uneven, therefore the Mn content is preferably 11.0% or less. The lower limit of the Mn content is preferably 1.0%, more preferably 2.0%, still more preferably 2.5%, even still more preferably 3.0%, most preferably 3.5%. The upper limit of the Mn content is preferably 10.0%, more preferably 9.5%, still more preferably 9.0%, even still more preferably 8.5%, most preferably 8.0%.

(Si: 0.05% or More and 2.50% or Less)

Si (silicon) is an element effective for improving the strength of the steel sheet. To sufficiently secure the strength, the Si content is preferably 0.05% or more. On the other hand, if excessively containing Si, the workability sometimes falls, therefore the Si content is preferably 2.50% or less. The lower limit of the Si content is preferably 0.10%, more preferably 0.15%, still more preferably 0.20%, most preferably 0.30%. The upper limit of the Si content is preferably 2.00%, more preferably 1.80%, still more preferably 1.50%, most preferably 1.20%.

(Al: 0.001% or More and 1.500% or Less)

Al (aluminum) is an element acting as a deoxidizing element. To obtain the effect of deoxidation, the Al content is preferably 0.001% or more. On the other hand, if excessively containing Al, the workability is liable to fall, therefore the Al content is preferably 1.500% or less. The lower limit of the Al content is preferably 0.010%, more preferably 0.020%, still more preferably 0.050%, most preferably 0.100%. The upper limit of the Al content is preferably 1.000%, more preferably 0.800%, still more preferably 0.700%, most preferably 0.500%.

(P: 0.100% or Less)

(S: 0.100% or Less)

(N: 0.010% or Less)

(O: 0.010% or Less)

P (phosphorus), S (sulfur), N (nitrogen), and O (oxygen) are impurities. The less the better, therefore the lower limits of these elements are not particularly prescribed. However, the contents of these elements may also be more than 0.000% or 0.001% or more. On the other hand, if excessively containing these elements, the toughness, ductility, and/or workability are liable to deteriorate, therefore preferably the upper limits of P and S are 0.100% and the upper limits of N and O are 0.010%. The upper limits of P and S are preferably 0.080%, more preferably 0.050%. The upper limits of N and O are preferably 0.008%, more preferably 0.005%.

The basic chemical composition of the steel sheet in the present invention is as explained above. Furthermore, the steel sheet may, in accordance with need, contain at least one of the following optional elements in place of part of the balance of Fe. For example, the steel sheet may contain B: 0% or more and 0.0040%. Further, the steel sheet may contain Cr: 0% or more and 2.00% or less. Further, the steel sheet may contain at least one element selected from the group consisting of Ti: 0% or more and 0.300% or less, Nb: 0% or more and 0.300% or less, V: 0% or more and 0.300% or less, and Zr: 0% or more and 0.300% or less. Further, the steel sheet may contain at least one element selected from the group consisting of Mo: 0% or more and 2.000% or less, Cu: 0% or more and 2.000% or less, and Ni: 0% or more and 2.000% or less. Further, the steel sheet may contain Sb: 0% or more and 0.100% or less. Further, the steel sheet may contain at least one element selected from the group consisting of Ca: 0% or more and 0.0100% or less, Mg: 0% or more and 0.0100% or less, and REM: 0% or more and 0.1000% or less. Below, these optional elements will be explained in detail.

(B: 0.0040% or Less)

B (boron) is an element effective for improving the hardenability at the time of hot stamping. The B content may be 0%, but to reliably obtain this effect, the B content is preferably 0.0005% or more. On the other hand, if excessively containing B, the workability of the steel sheet is liable to fall, therefore the B content is preferably made 0.0040% or less. The lower limit of the B content is preferably 0.0008%, more preferably 0.0010%, still more preferably 0.0015%. Further, the upper limit of the B content is preferably 0.0035%, more preferably 0.0030%.

(Cr: 0% or More and 2.00% or Less)

Cr (chromium) is an element effective for improving the hardenability at the time of hot stamping. The Cr content may be 0%, but to reliably obtain this effect, the Cr content is preferably 0.01% or more. The Cr content may also be 0.10% or more, 0.50% or more, or 0.70% or more. On the other hand, if excessively containing Cr, the thermal stability of the steel material sometimes falls. Therefore, the Cr content is preferably 2.00% or less. The Cr content may also be 1.50% or less, 1.20% or less, or 1.00% or less.

(Ti: 0% or More and 0.300% or Less)

(Nb: 0% or More and 0.300% or Less)

(V: 0% or More and 0.300% or Less)

(Zr: 0% or More and 0.300% or Less)

Ti (titanium), Nb (niobium), V (vanadium), and Zr (zirconium) are elements improving the tensile strength through reinfinement of the metal structure. The contents of these elements may be 0%, but to reliably obtain this effect, the Ti, Nb, V, and Zr contents are preferably 0.001% or more and may be 0.010% or more, 0.020% or more, or 0.030% or more as well. On the other hand, if excessively containing Ti, Nb, V, and Zr, the effect becomes saturated and the production costs rise. For this reason, the Ti, Nb, V, and Zr contents are preferably 0.300% or less and may be 0.150% or less, 0.100% or less, or 0.060% or less as well.

(Mo: 0% or More and 2.000% or Less)

(Cu: 0% or More and 2.000% or Less)

(Ni: 0% or More and 2.000% or Less)

Mo (molybdenum), Cu (copper), and Ni (nickel) have actions raising the tensile strength. The contents of these elements may be 0%, but to reliably obtain this effect, the Mo, Cu, and Ni contents are preferably 0.001% or more and may be 0.010% or more, 0.050% or more, or 0.100% or more as well. On the other hand, if excessively containing Mo, Cu, and Ni, sometimes the thermal stability of the steel material falls. Therefore, the Mo, Cu, and Ni contents are preferably 2.000% or less and may be 1.500% or less, 1.000% or less, or 0.800% or less.

(Sb: 0% or More and 0.100% or Less)

Sb (antimony) is an element effective for improving the wettability and adhesion of plating. The Sb content may also be 0%, but to reliably obtain this effect, the Sb content is preferably 0.001% or more. The Sb content may also be 0.005% or more, 0.010% or more, or 0.020% or less. On the other hand, if excessively containing Sb, sometimes a drop in the toughness is triggered. Therefore, the Sb content is preferably 0.100% or less. The Sb content may also be 0.080% or less, 0.060% or less, or 0.050% or less.

(Ca: 0% or More and 0.0100% or Less)

(Mg: 0% or More and 0.0100% or Less)

(REM: 0% or More and 0.1000% or Less)

Ca (calcium), Mg (magnesium), and REM (rare earth metals) are elements improving the toughness after hot stamping by adjusting the shapes of the inclusions. The contents of these elements may also be 0%, but to reliably obtain this effect, the Ca, Mg, and REM contents are preferably 0.0001% or more and may be 0.0010% or more, 0.0020% or more, or 0.0040% or more as well. On the other hand, if excessively containing Ca, Mg, and REM, the effect becomes saturated and the production costs rise. For this reason, the Ca and Mg contents are preferably 0.0100% or less and may be 0.0080% or less, 0.0060% or less, or 0.0050% or less as well. Similarly, the REM content is preferably 0.1000% or less and may be 0.0800% or less, 0.0500% or less, or 0.0100% or less as well.

The balance other than the above elements consists of iron and impurities. Here, the "impurities" include constituents entering during various factors in the production process such as the ore, scrap, or other raw materials when industrially producing the steel sheet and not intentionally added to the steel sheet according to the embodiments of the present invention.

Further, the "impurities" include elements which are other than the constituents explained above and which are contained in the steel sheet at a level where the actions and effects unique to the elements do not affect the properties of the hot stamped body according to the embodiments of the present invention.

The steel sheet in the present invention is not particularly limited. Hot rolled steel sheet, cold rolled steel sheet, and other general steel sheet can be used. Further, the steel sheet in the present invention may be any thickness so long as enabling formation of the later explained Zn—Ni plating layer on the steel sheet and the hot stamping. For example, it may be 0.1 to 3.2 mm. To obtain the hot stamped body according to the present invention, the surface roughness Ra of the steel sheet is preferably 1.0 μm or more and 3.0 μm or less. If the surface roughness of the steel sheet is such a range, the contact area of the steel sheet and the Zn—Ni plating layer or other plating layer formed on the steel sheet surface is maintained at a constant amount and diffusion of the steel sheet constituents from the steel sheet to the plating layer at the time of hot stamping becomes easier to progress. On the other hand, if the surface roughness is too high, the ZnO region of the surface layer of the plating layer is liable to become excessively thick (for example, more than 5.0 μm).

[Plating Layer]

The plating layer in the present invention is comprised of a ZnO region and an Ni—Fe—Zn alloy region. The "ZnO region" means a region present on the surface side of the plating layer and having an oxygen concentration of 10 mass % or more. The remaining region of the plating layer is the Ni—Fe—Zn alloy region, i.e., the Ni—Fe—Zn alloy region means a region present on the steel sheet side of the plating layer and having an oxygen concentration of less than 10%. Therefore, the ZnO region and the Ni—Fe—Zn alloy region are present in a contiguous manner. The two regions form the plating layer. In the plating layer in the present invention, O is taken into the plating layer at the time of hot stamping, therefore the surface side of the plating layer becomes highest in oxygen concentration. The oxygen concentration decreases the further to the steel sheet side. Therefore, the part from the surface of the hot stamped body to the position where the oxygen concentration becomes 10 mass % is the ZnO region, while the remaining part of the plating layer becomes the Ni—Fe—Zn alloy region.

The plating layer of the hot stamped body according to the present invention, for example, can be obtained by forming a Zn—Ni alloy plating layer on a steel sheet, then hot stamping the sheet in an oxygen atmosphere (for example, air atmosphere or high concentration oxygen atmosphere having an oxygen concentration of 25 to 30%). Alternatively, for example, it is possible to form a Zn plating layer and Ni plating layer on a steel sheet, then hot stamp the sheet in an oxygen atmosphere. Further, to efficiently make the Fe and other steel sheet constituents diffuse in the plating layer to obtain the hot stamped body according to the present invention, overheating may be performed at the time of the hot stamping. "Overheating" means heat treatment for a short time period (for example, 3 to 10 seconds or so) at a temperature higher than the heating temperature of the hot stamping (for example, +50° C. or so) right before reaching the heating temperature of the hot stamping (holding temperature). By performing overheating, it is possible to make the steel sheet constituents diffuse more at the surface layer of the plating layer and reliably obtain the hot stamped body according to the present invention. Therefore, the constituents able to be contained in the plating layer in the present invention are, in addition to the elements contained in the plating layer before the hot stamping (typically Zn and Ni), elements contained in the steel sheet (for example, Fe, Mn, Si, etc.) and O taken in at the time of the hot stamping. The balance consists of impurities. Here, the "impurities" include not only elements which unavoidably enter in the production process, but also elements intentionally added in a range where the coating peeling resistance of the hot stamped body according to the present invention is not obstructed.

The concentrations of the constituents in the plating layer in the present invention are measured by quantitative analysis glow discharge spectroscopy (GDS). By quantitatively analyzing the plating layer from the surface in the depth direction using GDS, the distributions of concentration of the different constituents in the sheet thickness direction are quantitatively identified. Therefore, by measuring the distribution of concentration of oxygen of the plating layer using GDS and identifying the position where the oxygen concentration becomes 10 mass %, it is possible to differentiate a ZnO region and an Ni—Fe—Zn alloy region. The measurement conditions of the GDS may be a measurement size of 4 mmφ, Ar gas pressure: 600 Pa, electric power: 35 W, and measurement time period: 100 seconds. The apparatus used may be a GD-profiler 2 made by Horiba, Ltd.

The thickness of the plating layer in the present invention may, for example, be 3.0 μm or more and 20.0 μm or less per surface. Further, the ratio of the thickness accounted for by the ZnO region in the plating layer is not particularly limited, but from the viewpoint of securing the adhesion with the coating film and the corrosion resistance of the hot stamped body, 3% or more and 30% or less is preferable and 5% or more and 20% or less is more preferable. On the other hand, the ratio of the thickness accounted for by the Ni—Fe—Zn region in the plating layer is preferably 70% or more and 97% or less, more preferably 80% or more and 95% or less, from the viewpoint of securing corrosion resistance in scratches. The thickness of the plating layer can, for example, be measured by identifying the region of the plating layer from elemental analysis by quantitative analysis GDS and conversion to thickness. Alternatively, it can be measured by examining a cross-section of the hot stamped body according to the present invention by an electron microscope.

(ZnO Region)

In the hot stamped body according to the present invention, the plating layer has a ZnO region having an oxygen concentration of 10 mass % or more at the surface side of that plating layer. That ZnO region is typically a region where the Zn in the plating layer which had been formed before the hot stamping and the O in the atmosphere at the time of the hot stamping bond together, i.e., where Zn is oxidized and becomes ZnO.

In the ZnO region in the present invention, the average concentration of the total of Fe, Mn and Si is 5 mass % or more and 30 mass % or less. By the average concentration of the total of Fe, Mn and Si being this range, the strength of the ZnO region is improved, peeling or fracture of the ZnO itself is suppressed, and the coating peeling resistance of the hot stamped body can be sufficiently obtained. If the average concentration of the total of Fe, Mn and Si is less than 5 mass %, sufficient strength of the ZnO region is not obtained and the coating peeling resistance is liable to fall. Conversely, if more than 30 mass %, these elements, in particular Fe, excessively diffuse at the surface, the surface part of the hot stamped body is easily corroded, and the coating peeling resistance and/or corrosion resistance in scratches is liable to fall. In the present invention, it is sufficient that the average concentration of the total of Fe, Mn and Si in the ZnO region be in the above range. It is sufficient that at least one of Fe, Mn and Si be included, but preferably all of Fe, Mn and Si are contained. More preferably, Fe: 1 mass % or more and 10 mass % or less, Mn: 1 mass % or more and 10 mass % or less, and Si: 1 mass % or more and 10 mass % or less are included. The Fe, Mn and Si contained in the ZnO region derive from the steel sheet. More specifically, these elements, which are contained in the steel sheet, diffuse to the ZnO region of the plating layer at the time of hot stamping. In particular, the relatively easily oxidizable Mn and Si in the steel sheet can more remarkably diffuse to the surface layer side in the plating if hot stamping under conditions of an oxygen atmosphere. The average concentration of the total of these elements is preferably 7 mass % or more, more preferably 10 mass % or more or 15 mass % or more. Further, the average concentration of the total of these elements is preferably 28 mass % or less, more preferably 25 mass % or less, or 20 mass % or less.

In general, the ZnO near the surface of a hot stamped body obtained by hot stamping is sparse in density and has relatively low strength, therefore is in a state where peeling or fracture easily occurs. This being so, even if forming a coating film on a hot stamped body, part of the ZnO region is liable to peel off and as a result the coating film is liable to peel off, therefore there is a possibility that sufficient coating peeling resistance cannot be secured. The "coating peeling resistance" means the coating film not peeling off from the hot stamped body and includes the coating film peeling off from interface of the coating film and the hot stamped body and part of the ZnO region (part of the plating layer) peeling off resulting in the coating film on it peeling off. By elements other than zinc, i.e., Fe, Mn and Si, being contained in predetermined amounts in the ZnO region at the surface layer of that hot stamped body like the hot stamped body of the present invention, the strength of that ZnO region is improved. If the ZnO region becomes hard, it becomes difficult for the ZnO itself to peel off (fracture) and the coating peeling resistance is improved compared with a region of only ZnO not containing the above such elements.

The "average concentration of the total of Fe, Mn and Si" is found by equally dividing the region having an oxygen concentration of greater than or equal to 10% identified by quantitative analysis GDS (i.e., the ZnO region) into 10 sections, reading the Fe concentrations, Mn concentrations, and Si concentrations of the center positions of the sections from the GDS results, finding the totals of the concentrations of these elements at the sections, and averaging the obtained 10 totals of Fe, Mn and Si.

The ZnO region typically is higher in Zn concentration compared with the Ni concentration. For example, the Zn/Ni mass ratio at the ZnO region is 5.0 or more. "The Zn/Ni mass ratio at the ZnO region is 5.0 or more" means the mass ratio of Zn/Ni is 5.0 or more at all positions in the ZnO region. In the present invention, it is possible to equally divide the ZnO region into 10 sections, read the Zn concentrations and Ni concentrations of the center positions of the sections from the GDS results, find the Zn/Ni mass ratios of the sections, and judge if the obtained 10 Zn/Ni mass ratios are all 5.0 or more. The Zn/Ni mass ratio at the ZnO region is preferably 5.5 or more, more preferably 6.0 or more, still more preferably 7.0 or more. The upper limit of that region is not particularly limited, but, for example, may be 30.0 or 20.0.

Zn is present in a greater amount compared with Ni in the ZnO region of the hot stamped body in this way because at the time of the hot stamping in an oxygen atmosphere, among the Ni and Zn in the plating layer before the hot stamping, the Zn, which is more easily oxidized compared with the Ni, is oxidized by the O in the hot stamping atmosphere and forms ZnO. If the Zn/Ni mass ratio is 5.0 or more, a large amount of the oxides ZnO are present at the surface layer of the hot stamped body, therefore the corrosion resistance of the surface layer part of the hot stamped body is improved and the adhesion of the coating and the hot stamped body is also excellent. If the Zn/Ni mass ratio at the ZnO region is less than 5.0, ZnO is not sufficiently formed at the surface layer, therefore the corrosion resistance of the surface layer part and the coating adhesion are liable to become insufficient.

As explained above, the Zn/Ni mass ratio in the ZnO region can be obtained by hot stamping a steel sheet having a Zn—Ni alloy plating layer under conditions of, for example, an oxygen atmosphere (air condition or high concentration oxygen atmosphere having an oxygen concentration of 25 to 30%). If hot stamping under an oxygen atmosphere, the easily oxidizing Zn easily diffuses to the surface layer of the plating layer where it bonds with oxygen to form ZnO and thereby increases the area occupied by Zn, therefore as a result the Zn concentration at the ZnO region can be made higher than the Ni concentration. In other words, since it is oxidized by the oxygen in the atmosphere at the time of the hot stamping, the Zn in the plating layer is pulled toward the surface layer side whereby the concentration of Zn at the surface layer side of the plating layer becomes higher. Further, as explained above, to promote the diffusion of the steel sheet constituents to the surface layer of the plating layer, right before reaching the heating temperature at the time of the hot stamping, it is preferable to perform overheating for a short time period at a temperature higher than the heating temperature of the hot stamping.

The thickness of the ZnO region in the present invention is not particularly limited, but the lower limit is preferably 1.0 μm, more preferably 1.2 μm or 1.5 μm, still more preferably 1.8 μm or 2.0 μm. On the other hand, the upper limit is preferably 5.0 μm, more preferably 4.8 μm or 4.5 μm, still more preferably 4.3 μm or 4.0 μm. For example, the thickness of the ZnO region is preferably 1.0 μm or more and 5.0 μm or less, more preferably 2.0 μm or more and 5.0 μm or less. If the thickness of the ZnO region becomes less than 1.0 μm, the thickness of the ZnO region becomes insufficient and the corrosion resistance is liable to fall. If the thickness of the ZnO region is more than 5.0 μm, the ZnO region becomes too thick and the possibility of peeling or fracture arising from the ZnO region becomes higher.

The concentrations of the constituents contained in the ZnO region in the present invention, as explained above, are determined by quantitative analysis GDS. Under the same conditions as the above-mentioned GDS conditions, as the elements covered, at least Zn, Ni, O, Fe, Si, and Mn are designated and measured. Further, the thickness of the ZnO region can be determined by identifying the range of oxygen concentration equal to or greater than 10 mass % by quantitative analysis GDS and measuring that depth.

(Ni—Fe—Zn Alloy Region)

The hot stamped body according to the present invention has an Ni—Fe—Zn alloy region at the steel sheet side of the plating layer which is contiguous with the above-mentioned ZnO region and which has an oxygen concentration of less than 10 mass %. Preferably, that alloy region has Zn, Ni, O, Fe, Mn and Si present in it. That Ni—Fe—Zn alloy region typically is a region obtained by the Fe in the steel sheet diffusing into the plating layer at the time of the heating in the hot stamping whereby the Zn and Ni contained in the plating layer before the hot stamping and the Fe diffused from inside the steel sheet become alloyed. Further, the Mn and Si in the steel sheet also diffuse in the Ni—Fe—Zn alloy region simultaneously with the Fe and are alloyed.

In the Ni—Fe—Zn alloy region in the present invention, the concentrations of Zn, O, Mn and Si preferably decrease from the surface side of the plating layer toward the steel sheet side. In other words, in that alloy region, the Fe concentration preferably increases from the surface side of the plating layer toward the steel sheet side. "The concentrations of Zn, O, Mn and Si preferably decrease from the surface side of the plating layer toward the steel sheet side" means that in the Ni—Fe—Zn alloy region, the concentrations of these elements steadily decrease from the surface side of the plating layer toward the steel sheet side, i.e., in each of the elements listed, when measuring the concentrations at any two positions by GDS, etc., among the two positions, the position closer to the surface side of the plating layer is higher in concentration compared with the other position. It is sufficient that the concentration of each element steadily decrease. Linearity is not a concern. By establishing such distributions of concentration, sufficient Fe, Mn and Si are made to diffuse to the ZnO region on the surface side of the plating layer to secure the coating peeling resistance and corrosion resistance in scratches while in the Ni—Fe—Zn alloy region, the Ni and Zn of the plating layer before the hot stamping and the Fe in the steel sheet can be alloyed. Therefore, Ni—Fe—Zn alloy region may be comprised of, in order from a surface side of the plating layer, a first region having an Fe concentration of less than 60 mass % and a second region having an Fe concentration of 60 mass % or more. The first region and the second region in the Ni—Fe—Zn alloy region can be differentiated by measuring the Fe concentrations by quantitative analysis GDS.

The Ni—Fe—Zn alloy region is a region at the steel sheet side of the plating layer. Typically, at the time of the hot stamping, the Zn which had been contained in the plating layer before the hot stamping diffuses into the steel sheet. This diffusion occurs more remarkably the closer to the steel sheet. For this reason, in that alloy region, the concentration of Zn decreases from the surface side of the plating layer toward the steel sheet side. Further, O typically is contained in the atmosphere at the time of the hot stamping, therefore decreases in concentration in the plating layer the further from the surface side of the plating layer toward the steel sheet side. Furthermore, Mn and Si are elements present in the steel sheet before the hot stamping, but by the hot stamping in an oxygen atmosphere, due to their ease of oxidation, these can diffuse at the surface side of the plating layer more preferentially compared with Fe. Accordingly, in the alloy region, the concentrations of Mn and Si decrease from the surface side of the plating layer toward the steel sheet side.

In the present invention, the Zn/Ni mass ratio in the first region of the Ni—Fe—Zn alloy region is preferably a range of 2.0 or more and 15.0 or less. More preferably, in the first region, the Zn/Ni mass ratio continuously changes in the range of 2.0 or more and 15.0 or less from the surface side to the steel sheet side of the plating layer. The "Zn/Ni mass ratio in the first region is preferably a range of 2.0 or more and 15.0 or less" means the Zn/Ni mass ratio is within a range of 2.0 or more and 15.0 of less at all positions in the first region. In the present invention, it is possible to equally divide the first region into 10 sections, read the Zn concentrations and Ni concentrations of the center positions of the sections from the GDS results, find the Zn/Ni mass ratios of the sections, and judge if the obtained 10 Zn/Ni mass ratios are all 2.0 or more and 15.0 or less. If the Zn/Ni mass ratio at the first region is the above range, a sufficient amount of Zn can be secured at that region and furthermore a sufficient amount of Zn can be obtained at other regions. For this reason, even if the plating layer of the hot stamped body is scratched, the Zn present at that region will be oxidized to ZnO and an oxide coating film will be formed (called "sacrificial anticorrosive action") whereby the scratched part can be kept from corroding and the corrosion resistance in scratches of the hot stamped body can be improved. If the Zn/Ni mass ratio in the first region becomes less than 2.0, the sacrificial anticorrosive action of Zn cannot be sufficiently exhibited and the corrosion resistance in scratches is liable to become insufficient. On the other hand, if more than 15.0, the corrosion resistance of the hot stamped body as a whole is liable to become insufficient since the Zn in other regions can become insufficient. The lower limit of the Zn/Ni mass ratio in the first region is preferably 2.5, more preferably 3.0, while the upper limit is preferably 14.0, more preferably 13.0, still more preferably 12.0.

In the present invention, the average Zn/Ni mass ratio in the second region is preferably 0.5 or more and 2.0 or less. As explained above, the Zn in the plating layer which had been formed before the hot stamping diffuses to the surface side of the plating layer and into the steel sheet at the time of hot stamping, but in the hot stamped body according to the present invention, a predetermined amount of Zn remains at the second region of the Ni—Fe—Zn alloy region contiguous with the steel sheet. If Zn remains in the above range in that second region, even if the plating layer or further the underlying steel sheet is scratched, the sacrificial anticorrosive action of the Zn can be exhibited, therefore the corrosion resistance in scratches can be improved. If the average Zn/Ni mass ratio in the second region is less than 0.5, the sacrificial anticorrosive action of the Zn cannot be sufficiently exhibited and the corrosion resistance in scratches is liable to become insufficient. On the other hand, if more than 2.0, Zn is liable to not sufficiently diffuse at the surface layer part of the plating layer or Zn is liable to become insufficient in the first region and the corrosion resistance of the hot stamped body as a whole is liable to become insufficient. Due to the insufficient corrosion resistance of the hot stamped body as a whole, the coating peeling resistance sometimes falls somewhat or the corrosion resistance in scratches falls. The average Zn/Ni mass ratio in the second region is preferably 0.6 or more, more preferably 0.7 or more, still more preferably 0.8 or more. Further, the average Zn/Ni mass ratio in the second region is preferably 1.9 or less or 1.8 or less, more preferably 1.7 or less or 1.5 or less, still more preferably 1.2 or less. Therefore, most preferably the average Zn/Ni mass ratio in the second region is 0.8 or more and 1.2 or less.

The "average Zn/Ni mass ratio in the second region" can be found by equally dividing the region with an Fe concentration of the Ni—Fe—Zn alloy region equal to or greater than 60% (second region) into 10 sections, reading the Zn concentrations and Ni concentrations of the center positions of the sections from the GDS results, finding the Zn/Ni mass ratios of the sections, and averaging the obtained 10 Zn/Ni mass ratios.

The thickness of the Ni—Fe—Zn alloy region can be determined by identifying the range of oxygen concentration less than 10 mass % by quantitative analysis GDS and measuring the thickness. Further, similarly, the thicknesses of the first region (Fe concentration less than 60 mass %) and the second region (Fe concentration equal to or greater than 60 mass %) of the Ni—Fe—Zn alloy region can be determined from the Fe concentration obtained by GDS.

According to a specific embodiment of the present invention, by suitably controlling the thickness of the ZnO region and the Zn/Ni mass ratios of the first region and the second region in the Ni—Fe—Zn alloy region, for example, by controlling the thickness of the ZnO region to 1.0 μm or more and 5.0 μm or less, the Zn/Ni mass ratio in the first region to 2.0 or more and 15.0 or less, preferably 2.5 or more and 15.0 or less, and the average Zn/Ni mass ratio in the second region to 0.5 or more and 2.0 or less to optimize the plating layer, it becomes possible to further improve the coating peeling resistance of the hot stamped body and more specifically achieve a long term coating peeling resistance of that hot stamped body.

The hot stamped body according to the present invention can be suitably used for an automobile member. If used for an automobile member, the hot stamped body may be treated by a chemical conversion solution (for example, PB-SX35 made by Nihon Parkerizing Co., Ltd.), then coated by an electrodeposition coating (for example, Powernics 110 made by Nippon Paint Industrial Coatings Co., Ltd.) and baked at a temperature of 120 to 250° C. to form a coating film. The thickness of this coating film may be, for example, 5 to 30 μm.

<Method of Production of Hot Stamped Body>

An example of the method of production of the hot stamped body according to the present invention will be explained next. The hot stamped body according to the present invention can be obtained by forming on at least one surface, preferably both surfaces, of a steel sheet, for example a Zn—Ni plating layer by electroplating, then hot stamping the obtained plated steel sheet under predetermined conditions. Instead of a Zn—Ni plating layer, it is also possible to form a Zn plating layer and an Ni plating layer. Below, the case of forming a Zn—Ni plating layer will be explained.

(Production of Steel Sheet)

The method of production of the steel sheet used for producing the hot stamped body according to the present invention is not particularly limited. For example, it is possible to adjust the molten steel in chemical composition to the desired ranges, hot roll it, coil it, and further cold roll it to obtain a steel sheet. The thickness of the steel sheet in the present invention may, for example, be 0.1 mm to 3.2 mm. The steel sheet in the present invention, as explained above, makes the Fe and other steel constituents diffuse into the plating layer to obtain the hot stamped body according to the present invention. To obtain this, the surface roughness Ra of the steel sheet is preferably made 1.0 μm or more and 3.0 μm or less. The method of obtaining such a surface roughness is not particularly limited. This can be performed by a method known to persons skilled in the art.

The chemical composition of the steel sheet used is not particularly limited, but as explained above, the steel sheet preferably contains, by mass %, C: 0.05% or more and 0.70% or less, Mn: 0.5% or more and 11.0% or less, Si: 0.05% or more and 2.50% or less, Al: 0.001% or more and 1.500% or less, P: 0.100% or less, S: 0.100% or less, N: 0.010% or less, O: 0.010% or less, and B: 0.0005% or more and 0.0040% or less and has a balance of iron and impurities.

(Formation of Plating Layer)

The method of formation of the Zn—Ni plating layer is not particularly limited, but the layer is preferably formed by electroplating. Further, before forming this plating, Ni, etc., may be plated as preplating. Below, the case of forming the Zn—Ni plating layer by electroplating will be explained.

Regarding the Zn—Ni plating layer on the steel sheet formed by the electroplating, as the plating deposition amount, for example, 25 $g/m^2$ or more and 90 $g/m^2$ or less per surface is preferable, while 30 $g/m^2$ or more and 50 $g/m^2$ or less is more preferable. The Zn/Ni ratio of the plating layer may, for example, be 3.0 or more and 20.0 or less. 4.0 or more and 10.0 or less is preferable. The composition of the bath used for forming the Zn—Ni plating layer may, for example, be nickel sulfate hexahydrate: 25 to 350 g/liter, zinc sulfate heptahydrate: 10 to 150 g/liter, and sodium sulfate: 25 to 75 g/liter. Further, the current density may be 10 to 150 A/dm$^2$. The bath composition and the current density can be suitably adjusted so that the desired plating deposition amount and Zn/Ni ratio are obtained. The bath temperature and bath pH may be suitably adjusted so that plating burns do not occur. For example, they may be respectively 40 to 70° C. and 1.0 to 3.0. The plating deposition amount and Zn/Ni ratio of the Zn—Ni plating layer formed can be measured by inductively coupled plasma (ICP) emission spectroscopy.

(Hot Stamping)

Next, the steel sheet formed with the Zn—Ni plating layer is hot stamped. The heating temperature of the hot stamping need only enable the steel sheet to be heated to the temperature of the austenite region. For example, it is a range of 800° C. or more and 1000° C. or less. The rate of temperature rise is preferably 2 to 10° C./s, more preferably 3 to 5° C./s. If the rate of temperature rise is too slow, Fe will excessively diffuse to the surface and the average concentration of the total of the Fe, Mn and Si in the finally obtained ZnO region will sometimes be more than 30 mass % and/or the ZnO region will sometimes become too thick. On the other hand, if the rate of temperature rise is too fast, the finally obtained plating layer will be degraded in appearance and sometimes a quality sufficient as a finished product will be unable to be secured. The holding time after heating can be suitably set to 0.5 minute or more and 5.0 minutes or less, more preferably 1.0 minute or more and 4.0 minutes or less, most preferably 2.0 minutes or more and 4.0 minutes or less. If the holding time is too short, the desired amount of diffusion is liable to not occur, while if conversely too long, the ZnO region is liable to become too thick. The heating temperature, rate of temperature rise, and holding time are interrelated with the diffusion of the constituents of the steel sheet from the steel sheet to the plating layer and the formation of the ZnO region, etc. For this reason, by just controlling the values of the parameters to within the above ranges, sometimes the desired configuration of the plating layer cannot be obtained. For example, if the rate of temperature rise is relatively slow or if performing overheating, the holding time after the heating may be made relatively short, but if the rate of temperature rise is relatively fast or if overheating is not performed, to obtain the desired configuration of the plating layer, it is necessary to make the holding time after heating relatively long. In addition, the specific examples of the heating temperature, rate of temperature rise, and holding time are affected by the composition and amount of deposition of the plating, the thickness of the steel sheet, the presence of any overheating, etc. Furthermore, even with the same heating temperature and holding time, it is possible to change the features of the plating layer finally obtained according to whether the steel sheet is hot stamped as is at a relatively high temperature right after being taken out from a heating furnace or whether it is hot stamped after allowing it to cool down to a predetermined temperature. Therefore, even with the same heating temperature, rate of temperature rise, and holding time, it is possible to change the features of the plating layer according to the composition and amount of deposition of the plating, the thickness of the steel sheet, the presence of any overheating, the temperature when actually performing the hot stamping, etc. For this reason, the specific values of the heating temperature, rate of temperature rise, holding time, etc., are preferably suitably selected considering the composition and amount of deposition of the plating, the thickness of the steel sheet, the presence of any overheating, the temperature when actually performing the hot stamping, and other conditions.

Further, to obtain the hot stamped body according to the present invention, at the time of this hot stamping, overheating may be performed. Due to this overheating, it becomes possible to make the Fe and other steel sheet constituents efficiently diffuse in the plating layer. The product of the difference between the overheating temperature and the heating temperature of the hot stamping (below, referred to as the "overtemperature") and the overheat time (seconds) is preferably 150 or more and 300 or less. Further, the overtemperature is preferably 25° C. or more and 150° C. or less and the overheat time 3 seconds or more. The atmosphere at the time of the hot stamping is preferably a 10 to 30% oxygen atmosphere. For example, the hot stamping can be performed in an air atmosphere or a high concentration oxygen atmosphere with an oxygen concentration of 25 to 30%. By performing the hot stamping in a high dew point atmosphere such as an oxygen atmosphere, it is possible to proactively make the Zn in the plating layer and the Fe, Si, and Mn in the steel sheet, particularly the easily oxidizable Zn, Si, and Mn, diffuse at the surface side of the plating layer and ensure the presence of the desired amounts of the elements at the surface side of the plating layer. For this reason, by performing the hot stamping including overheating under the above conditions, in particular an oxygen atmosphere, the ZnO region and Ni—Fe—Zn alloy region in the present invention are formed and Fe, Si, and Mn are diffused in that ZnO region in the desired amounts. Further, after the heat treatment, for example, cooling (quenching) can be performed by a cooling rate of a range of 10 to 100° C./s.

By suitably adjusting the amount of deposition of the plating layer and Zn/Ni ratio before the hot stamping and the hot stamping conditions (for example, temperature, rate of temperature rise, holding time, oxygen concentration in atmosphere, overheating conditions, etc.), it is possible to form the ZnO region and Ni—Fe—Zn alloy region, more specifically the ZnO region and the first region and the second region of the Ni—Fe—Zn alloy region, and adjust the concentrations of the elements and thicknesses of the respective regions.

EXAMPLES

The hot stamped body according to the present invention will be explained in more detail below while giving several examples. However, it is not intended that the scope of the invention described in the claims be limited by the specific examples explained below.

(Formation of Plating Layer)

A thickness 1.4 mm cold rolled steel sheet was dipped in a plating bath having the following plating bath composition and electroplated to form a Zn—Ni plating layer on both surfaces of that cold rolled steel sheet. The pH of the plating bath was 2.0, the bath temperature was maintained at 60° C., and the current density was 30 to 50 A/dm$^2$. All of the steel sheets used contained, by mass %, C: 0.50%, Mn: 3.0%, Si: 0.50%, Al: 0.100%, P: 0.010%, S: 0.020%, N: 0.003%, O: 0.003%, and B: 0.0010% and had a balance of iron and impurities. Further, in all of the steel sheets, the surface roughness Ra=1.5 μm.

Plating Bath Composition nickel sulfate hexahydrate: 25 to 250 g/liter (variable)

zinc sulfate heptahydrate: 10 to 150 g/liter (variable)

sodium sulfate: 50 g/liter (fixed)

In the Zn—Ni plating layer, to obtain the desired plating deposition amount and Zn/Ni ratio, the plating bath composition (concentrations of nickel sulfate hexahydrate and zinc sulfate heptahydrate), the current density, and the conduction time period were adjusted. The plating deposition amount (g/m$^2$) and Zn/Ni ratio at the Zn—Ni alloy plating layer on the steel sheet obtained by electroplating were measured by ICP. The results of measurement are shown in Table 1. The "plating deposition amount" shows the amount of deposition per single surface.

(Hot Stamping)

Next, the obtained Zn—Ni plated steel sheet was hot stamped under the conditions shown in Table 1. More specifically, the hot stamping was performed at a temperature of more than 800° C. right after heating and holding at the temperature and time period shown in Table 1 then quenching was performed by a cooling rate of 30° C./s. In Sample No. 3, the atmosphere at the time of heating was a low oxygen atmosphere having an oxygen concentration of about 5% (low dew point atmosphere). In the other samples, the hot stamping was formed in an air atmosphere (oxygen concentration about 20%). In Sample Nos. 1 to 12, 15, and 17, furnace heating was used for heating, while in Sample No. 16, ohmic heating was used for heating. The rate of temperature rise of Sample No. 16 is 30° C./s, but in this sample, the rate of temperature rise was gradually lowered and no overheating performed before reaching the target temperature of 900° C. On the other hand, in Sample Nos. 13 and 14, overheating was performed. For that overheating, furnace heating and ohmic heating were jointly used. First, furnace heating was used for heating, next, right before 900° C., ohmic heating was jointly used to raise the temperature up to 950° C. all at once, after reaching 950° C., the ohmic heating was ended and only furnace heating was used hold the temperature and then return it to 900° C. (overtemperature=50° C.). The overheat time was 4 seconds. Therefore, in Sample Nos. 13 and 14, the product of the overtemperature and the overheat time was 200 (that value shown by "overheat condition" in Table 1"). The rate of temperature rise of Sample Nos. 13 and 14 in Table 1 shows the rate of temperature rise before the overheating.

(Quantitative Analysis GDS of Plating Layer)

The elements contained in the plating layer of each sample obtained after the hot stamping were measured using a GD-profiler 2 made by Horiba, Ltd. in a depth direction of the plating layer (thickness direction) by quantitative analysis GDS. The measurement conditions of the GDS were made a measurement size of 4 mmφ, Ar gas pressure: 600 Pa, electric power: 35 W, and measurement time period: 100 seconds. The measured elements were Zn, Ni, Fe, Mn, Si, and O. Specifically, first, the sample was divided into a region having an oxygen concentration of 10 mass % or more by GDS and a region having an oxygen concentration of less than 10 mass %, these were respectively defined as the ZnO region and the Ni—Fe—Zn alloy region, and the thickness of the ZnO region was determined. Further, from the concentrations of Zn, O, Mn and Si at the Ni—Fe—Zn alloy region, it was checked if the concentrations of these elements decreased from the surface side of the plating layer toward the steel sheet side. Next, the identified ZnO region was divided at equal intervals into 10 sections, the Fe concentrations, Mn concentrations, and Si concentrations of the center positions of the sections were read from the GDS results, the totals of these concentrations at the sections were found, and the values of the 10 total concentrations of the Fe, Mn and Si obtained were averaged to thereby determine the average concentrations of the totals of Fe, Mn and Si of the sample. Next, from the obtained GDS results, the Ni—Fe—Zn alloy region was divided into a region having an Fe concentration of less than 60 mass % (first region) and a region having an Fe concentration of 60 mass % or more (second region). From the Zn concentration and Ni concentration at the first region, the maximum value and minimum value of the Zn/Ni mass ratio were found and the range of the Zn/Ni mass ratio in the first region was identified. Further, the second region was divided at equal intervals into 10 sections, the Zn concentrations and Ni concentrations of the center positions of the sections were read and the Zn/Ni mass ratios were found, and the 10 Zn/Ni mass ratios obtained were averaged to determine the average Zn/Ni mass ratio in the second region. The average concentration of the total of Fe, Mn and Si, the Zn/Ni mass ratio in the first region, the average Zn/Ni mass ratio in the second region, and the thickness of the ZnO region of each sample are shown in Table 2. Regarding the "distributions of concentrations of Zn, O, Mn and Si in Ni—Fe—Zn alloy region" in Table 2, cases where all of these elements decreased in the Ni—Fe—Zn alloy region from the surface side of the plating layer toward the steel sheet side were shown as "good", while cases where they did not were shown as "poor".

(Evaluation of Coating Peeling Resistance)

A 100 mm×100 mm size evaluation-use sample was cut out from each sample, that sample was treated by a chemical conversion solution (PB-SX35 made by Nihon Parkerizing Co., Ltd.), then this was coated by an electrodeposition coating (for example, Powernics 110 made by Nippon Paint Industrial Coatings Co., Ltd.) and baked at 200° C. to give a coating thickness of 10 μm. After that, the surface of the evaluation-use sample was formed with 11 cuts at 1 mm intervals respectively vertically and horizontally. The total 100 grid-shaped cuts were subjected to a peeling test using adhesive tape and were evaluated for coating peeling resistance. Cases where the number of grid parts exhibiting peeling was less than 20 were evaluated as "very good" in coating peeling resistance, cases where the number was 20 or more and less than 30 were evaluated as "good" in coating peeling resistance, and cases where the number was 30 or more were evaluated as "poor" in coating peeling resistance. The results of evaluation of the samples are shown in Table 2.

(Evaluation of Coating Peeling Resistance Secondary Adhesion)

To evaluate the long-term coating peeling resistance, the following procedure was followed to evaluate the coating peeling resistance secondary adhesion of the hot stamped body. First, the evaluation-use samples chemically converted and electrodeposition coated in the above-mentioned way were subjected to a JASO-CCT test (M609-91) with spraying by saline (5% NaCl, 35° C.): 2 hours, drying (60° C., 20 to 30% RH): 4 hours, and wetting (50° C., 95% RH): 2 hours for 200 cycles without being formed with cross-cut scratches. Next, the surfaces of the evaluation-use samples after 200 cycles were formed with 11 cuts at 1 mm intervals respectively vertically and horizontally. The total 100 grid-shaped cuts were subjected to a peeling test using adhesive tape and were evaluated for coating peeling resistance secondary adhesion. Cases where the number of parts with peeling was less than 10 were evaluated as "excellent" in coating peeling resistance secondary adhesion, cases where the number with peeling was 10 or more and less than 30 were evaluated as "very good" in coating peeling resistance secondary adhesion, cases where the number was 30 or more and less than 50 were evaluated as "good" in coating peeling resistance secondary adhesion, and cases where the number was 50 or more were evaluated as "poor" in coating peeling resistance secondary adhesion. The results of evaluation of the samples are shown in Table 2.

(Evaluation of Corrosion Resistance in Scratches)

The evaluation-use samples chemically converted and electrodeposition coated in the above-mentioned way were formed with diagonal length 70 mm cross-cut scratches reaching the underlying steel sheet, then subjected to a JASO-CCT test (M609-91) with spraying by saline (5%

NaCl, 35° C.): 2 hours, drying (60° C., 20 to 30% RH): 4 hours, and wetting (50° C., 95% RH): 2 hours for 180 cycles and evaluated for corrosion resistance in scratches. In the evaluation-use samples after 180 cycles, cases with blister widths of 2 mm or less were evaluated as "good" in corrosion resistance in scratches while those of more than 2 mm were evaluated as "poor" in corrosion resistance in scratches. The results of evaluation of the samples are shown in Table 2.

TABLE 1

Plating Layers Before Hot Stamping and Hot Stamping Conditions

| | Zn—Ni plating layer before hot stamping | | Hot stamping conditions | | | | |
|---|---|---|---|---|---|---|---|
| Sample no. | Zn/Ni ratio | Zn—Ni plating deposition (g/m$^2$) | Rate of temperature rise (° C./s) | Heating temperature (° C.) | Holding time (min) | Overheat conditions | Atmosphere |
| 1 | 6.7 | 40.0 | 5 | 900 | 3.0 | — | Air |
| 2 | 6.7 | 40.0 | 3 | 900 | 1.0 | — | Air |
| 3 | 6.7 | 40.0 | 5 | 900 | 1.0 | — | Low dew point |
| 4 | 9.0 | 40.0 | 3 | 900 | 2.0 | — | Air |
| 5 | 9.0 | 40.0 | 2 | 900 | 1.0 | — | Air |
| 6 | 5.7 | 40.0 | 5 | 900 | 3.0 | — | Air |
| 7 | 5.7 | 40.0 | 2 | 900 | 1.0 | — | Air |
| 8 | 19.0 | 40.0 | 2 | 900 | 3.0 | — | Air |
| 9 | 4.0 | 40.0 | 2 | 900 | 1.0 | — | Air |
| 10 | 6.7 | 40.0 | 10 | 950 | 4.0 | — | Air |
| 11 | 5.7 | 20.0 | 5 | 950 | 4.0 | — | Air |
| 12 | 32.3 | 40.0 | 8 | 900 | 3.0 | — | Air |
| 13 | 6.7 | 40.0 | 10 | 900 | 1.0 | 200 | Air |
| 14 | 9.0 | 40.0 | 10 | 900 | 1.0 | 200 | Air |
| 15 | 7.3 | 45.0 | 1 | 950 | 2.5 | — | Air |
| 16 | 7.3 | 45.0 | 30 | 900 | 0.0 | | Air |
| 17 | 9.0 | 50.0 | 4 | 900 | 1.0 | — | Air |

TABLE 2

Properties of Plating Layer and Results of Evaluation

| | Properties of plating layer | | | | | Evaluation | | | |
|---|---|---|---|---|---|---|---|---|---|
| Sample no. | Average concentration of total of Fe, Mn and Si in ZnO region (mass %) | Distributions of concentrations of Zn, O, Mn and Si in Ni—Fe—Zn alloy region | Zn/Ni mass ratio of first region | Zn/Ni mass ratio of second region | Thickness of ZnO region (μm) | Evaluation of coating peeling resistance | Evaluation of coating peeling resistance secondary adhesion | Evaluation of corrosion resistance in scratches | Remarks |
| 1 | 19 | Good | 2.5 to 8.0 | 0.9 | 4.8 | Very good | Excellent | Good | Ex. |
| 2 | 12 | Good | 3.8 to 12.0 | 1.0 | 2.9 | Very good | Very good | Good | Ex. |
| 3 | 4 | Poor | 3.0 to 5.7 | 2.2 | 2.0 | Poor | Poor | Poor | Comp. ex. |
| 4 | 17 | Good | 2.7 to 8.1 | 1.1 | 4.9 | Very good | Excellent | Good | Ex. |
| 5 | 14 | Good | 4.2 to 11.7 | 1.1 | 4.1 | Very good | Very good | Good | Ex. |
| 6 | 18 | Good | 2.4 to 7.8 | 0.9 | 4.8 | Very good | Good | Good | Ex. |
| 7 | 17 | Good | 3.1 to 11.5 | 1.0 | 2.8 | Very good | Very good | Good | Ex. |
| 8 | 20 | Good | 2.9 to 8.4 | 1.2 | 5.9 | Good | Good | Good | Ex. |
| 9 | 9 | Good | 3.2 to 10.7 | 0.9 | 2.1 | Very good | Very good | Good | Ex. |
| 10 | 28 | Good | 2.1 to 7.2 | 0.8 | 6.2 | Good | Good | Good | Ex. |
| 11 | 35 | Poor | 2.2 to 7.6 | 0.8 | 8.0 | Poor | Poor | Poor | Comp. ex. |
| 12 | 20 | Good | 30.0 to 60.0 | 8.0 | 4.3 | Good | Good | Poor | Ex. |
| 13 | 15 | Good | 3.0 to 9.5 | 0.9 | 3.8 | Very good | Very good | Good | Ex. |
| 14 | 18 | Good | 3.0 to 10.5 | 1.0 | 4.9 | Very good | Very good | Good | Ex. |
| 15 | 32 | Poor | 2.0 to 7.4 | 1.2 | 6.5 | Poor | Poor | Good | Comp. ex. |
| 16 | — | — | — | — | — | — | — | — | — |
| 17 | 11 | Good | 4.4 to 11.1 | 2.1 | 3.4 | Very good | Poor | Poor | Ex. |

Cases where the coating peeling resistance was evaluated as very good or good (evaluations of coating peeling resistance secondary adhesion not included) were evaluated as hot stamped bodies having improved coating peeling resistance.

Sample Nos. 1, 2, 4 to 10, 12 to 14, and 17 had an average concentration of a total of Fe, Mn and Si in the ZnO region of 5 mass % or more and 30 mass % or less, therefore were excellent in coating peeling resistance. In particular, Sample Nos. 1, 2, 4, 5, 7, 9, 13, and 14 where the thickness of the ZnO region was 1.0 μm or more and 5.0 μm or less and the Zn/Ni mass ratio of the first region and the average Zn/Ni mass ratio of the second region were in predetermined ranges were more excellent in coating peeling resistance and, furthermore, were also excellent in coating peeling resistance secondary adhesion.

Further, Sample Nos. 1, 2, 4 to 10, 13, and 14 had concentrations of Zn, O, Mn and Si in the Ni—Fe—Zn alloy region decreasing from the surface sides of the plating layer toward the steel sheet side, had a Zn/Ni mass ratio of the first region of 2.0 or more and 15.0 or less, and had an average Zn/Ni mass ratio of the second region of 0.5 or more and 2.0 or less, therefore were excellent in corrosion resistance in scratches.

Sample No. 3 had an average concentration of the total of Fe, Mn and Si of the ZnO region of less than 5 mass %, therefore could not obtain sufficient strength in the ZnO region and was insufficient in coating peeling resistance. Further, Sample No. 11 had an average density of the total of the Fe, Mn and Si in the ZnO region of more than 30 mass %, therefore had a large amount of Fe, etc., at the surface layer of the hot stamped body and was easily corroded and as a result was insufficient in coating peeling resistance.

Sample No. 15 had too slow a rate of rise of temperature, therefore had Fe excessively diffusing to the surface and an average density of the total of Fe, Mn and Si of the ZnO region being more than 30 mass % and as a result was insufficient in coating peeling resistance. Sample No. 16 was too fast in rate of temperature rise and due to this was poor in appearance of the plating layer and could not obtain sufficient quality as a finished product, therefore was not analyzed for the plating layer or evaluated for its properties.

INDUSTRIAL APPLICABILITY

According to the present invention, it is possible to provide a hot stamped body increased in strength of a ZnO region present on a surface side of a plating layer, prevented from peeling or fracture of the ZnO itself, and improved in coating peeling resistance. Due to this, it is possible to provide an automobile member high in coating peeling resistance and excellent in corrosion resistance. Therefore, the present invention can be said to be an invention extremely high in value in industry.

The invention claimed is:

1. A hot stamped body comprising a steel sheet and a plating layer formed on at least one surface of the steel sheet, wherein the plating layer is comprised of a ZnO region present on a surface side of the plating layer and having an oxygen concentration of 10 mass % or more and an Ni—Fe—Zn alloy region present on a steel sheet side of the plating layer and having an oxygen concentration of less than 10 mass %, and an average concentration of a total of Fe, Mn and Si in the ZnO region is 5 mass % or more and 30 mass % or less, wherein concentrations of Zn, O, Mn and Si in the Ni—Fe—Zn alloy region decrease from the surface side of the plating layer toward the steel sheet side.

2. The hot stamped body according to claim 1, wherein the Ni—Fe—Zn alloy region is comprised of, in order from a surface side of the plating layer, a first region having an Fe concentration of less than 60 mass % and a second region having an Fe concentration of 60 mass % or more, a Zn/Ni mass ratio in the first region is 2.0 or more and 15.0 or less, and an average Zn/Ni mass ratio in the second region is 0.5 or more and 2.0 or less.

3. The hot stamped body according to claim 2, wherein the average Zn/Ni mass ratio in the second region is 0.8 or more and 1.2 or less.

4. The hot stamped body according to any one of claim 1, wherein a thickness of the ZnO region is 1.0 μm or more and 5.0 μm or less.

* * * * *